US008105555B2

(12) United States Patent
Lahti

(10) Patent No.: US 8,105,555 B2
(45) Date of Patent: Jan. 31, 2012

(54) PIPETTE TIP PACKAGE

(75) Inventor: Arto Lahti, Tuusula (FI)

(73) Assignee: Thermo Fisher Scientific Oy, Vantaa (FI)

( * ) Notice: Subject to any disclaimer, the term of this patent is extended or adjusted under 35 U.S.C. 154(b) by 127 days.

(21) Appl. No.: 12/574,845

(22) Filed: Oct. 7, 2009

(65) Prior Publication Data

US 2010/0143199 A1 Jun. 10, 2010

(30) Foreign Application Priority Data

Oct. 20, 2008 (FI) ..... 20085988

(51) Int. Cl.

| | |
|---|---|
| ***B01L 3/00*** | (2006.01) |
| ***B01L 3/02*** | (2006.01) |
| ***A47F 1/04*** | (2006.01) |
| ***B65D 85/20*** | (2006.01) |
| *B65D 1/34* | (2006.01) |
| *B65D 21/00* | (2006.01) |
| *B65D 81/02* | (2006.01) |
| *B65D 73/00* | (2006.01) |

(52) U.S. Cl. ..... 422/526; 422/400; 422/501; 422/524; 206/443; 206/562; 206/563; 206/564; 206/499; 206/486; 206/585; 211/60.1

(58) Field of Classification Search ..... None
See application file for complete search history.

(56) References Cited

U.S. PATENT DOCUMENTS

| | | | | |
|---|---|---|---|---|
| 3,853,217 | A * | 12/1974 | Scordato et al. | 206/223 |
| 5,445,270 | A | 8/1995 | Dratz | |
| 5,779,984 | A | 7/1998 | Kelly et al. | |
| 6,098,802 | A * | 8/2000 | Asa et al. | 206/443 |
| 6,405,870 | B1 * | 6/2002 | Lahti et al. | 206/499 |

FOREIGN PATENT DOCUMENTS

| | | |
|---|---|---|
| WO | WO 97/39827 | 10/1997 |

* cited by examiner

*Primary Examiner* — Brian J Sines
*Assistant Examiner* — Jennifer Wecker
(74) *Attorney, Agent, or Firm* — Nixon & Vanderhye P.C.

(57) ABSTRACT

The invention relates to a pipette tip package, which has one pipette tip (1) in an enclosure (2) with a closed bottom end and a top end tightly closed by a lid.

12 Claims, 3 Drawing Sheets

PIPETTE TIP PACKAGE

Figure 1:
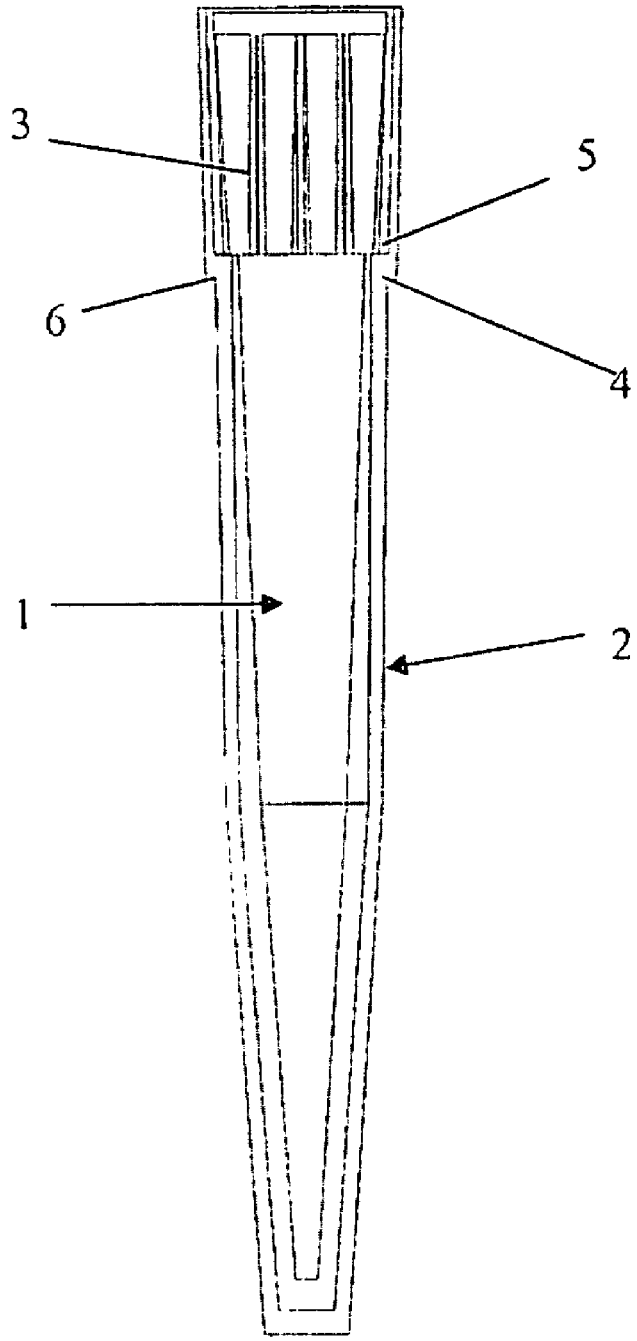

This application claims priority to Finland Patent Application No. 20085988 filed 20 Oct. 2008, the entire contents of which is hereby incorporated by reference.

TECHNICAL FIELD

The invention relates to pipettes for use in liquid dispensing and concerns tip cones or tips used therein. Tips according to the invention are suitable for use, for example, when utmost cleanness is required.

BACKGROUND ART

Pipettes are provided with disposable tip cones or tips, which are fixed to the end of a pipette's suction channel and into which the liquid to be pipetted is drawn. The pursuit of utmost cleanness is often a reason to use individually packed tips.

A traditional solution for individual packages has been a vacuum-molded channel type bag, in which the tip lies on its side. The bag has a heat-sealed cover. The bags are packed in bulk containers, which are then sterilized by irradiation. The user opens the bag at the tip attachment end and holds the tip through the bag while fixing the tip to a pipette.

There are also trays available for tips. In this case, the tip has a widened top end and the tray has holes for suspending the tips thereby. Picking up tips from a tray is easy, especially for a multichannel pipette. In the manufacture of sterile tray packages, the entire tray, along with its tips, is placed inside a bag which is then sterilized by irradiation.

GENERAL DESCRIPTION OF THE INVENTION

What has been invented now, is a tip package, and a method of manufacturing a tip package.

According to the invention, the pipette tip is placed in an enclosure with a closed bottom end and an open top end, such that the tip has its bottom end towards the bottom end of the enclosure. Then, the top end of the enclosure is tightly closed by fixing a lid thereto. The lid can be fixed for example by heat sealing, gluing or by a friction joint. After the closing operation, the package can still be sterilized, particularly by irradiation.

The user opens the lid and inserts the end of a pipette's suction channel into the tip. The procedure is easy and, while being fixed in place, the tip is exposed as little as possible to contamination.

Tips are manufactured virtually always from an suitable plastic by injection molding. The enclosure is also most conveniently manufactured by injection molding. Production is feasible with automated production lines currently in service. Cleanness in production is easily ensured in the manufacture of tips according to the invention. The invention enables also loading a tray in such a way that sterility is easily maintained.

The tip may have an enlargement in its upper part, constituting a shoulder with the tip's outer surface. The enlargement may consist of longitudinal ribs present in the upper part of the tip. The enclosure may have an internal reduction, specifically a shoulder, which responds to that of the tip. Hence, in the process of fixing it to a pipette, the tip can be pressed against the internal reduction of the enclosure for a good sealing effect. For this purpose, the enclosure must naturally be sufficiently rigid for pressing the tip against it with an adequate force.

The enclosure may also have in its upper part an enlargement on its outer surface. This enables loading the enclosure on a tray, which has an aperture for placing the enclosure therein to be suspended by the enlargement.

The tip package can be manufactured by closing each individual package separately. However, it is also possible to close several packages with a joint lid for a multi-tip package. Such a unit can then be cut for individual packages.

Nevertheless, the lid of a multi-tip package can be opened, as necessary, even without cutting the lid. In this case, the unit can be placed on a tray with an aperture for each enclosure. The enclosures are arranged in a multi-tip package most conveniently in straight rows. Hence, the lid can be formed always between the rows with a cut, such as a perforation. This enables an easy opening of the lid, one row at a time. From the tray, tips are handy to pick up from a row for a multichannel pipette of a matching pitch.

The invention is of a particular benefit, specifically in the case of tray packages. The fabrication of sterile packages is easier than at present. The only components that have to be supersterile are the tip, the interior of the enclosure, and the internal side of the lid. The enclosures can be manufactured in the immediate vicinity of tip production and possibly even concurrently with tips. After the enclosures are closed, the tips are protected from contaminations. There is no need of further protecting the product by a plastic bag, nor do the tips require a traditional perforated plate for shipping. Savings in material and labor are remarkable.

Less packaging material is needed and the size of shipped packages is smaller as the user need not be always supplied with a new tray along with the tips. There is no need to expose more tips from the tray than those required at a time, whereby the tips left in the tray remain absolutely clean.

According to the invention, it is easier than before to achieve the highly stringent requirements of certain applications, regarding the absence of nuclease and endotoxin.

DRAWINGS

Figure 4:
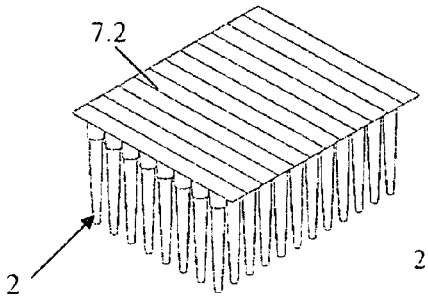
Figures 3, 5:
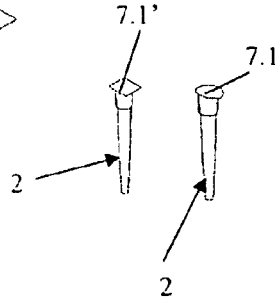
Figure 6:
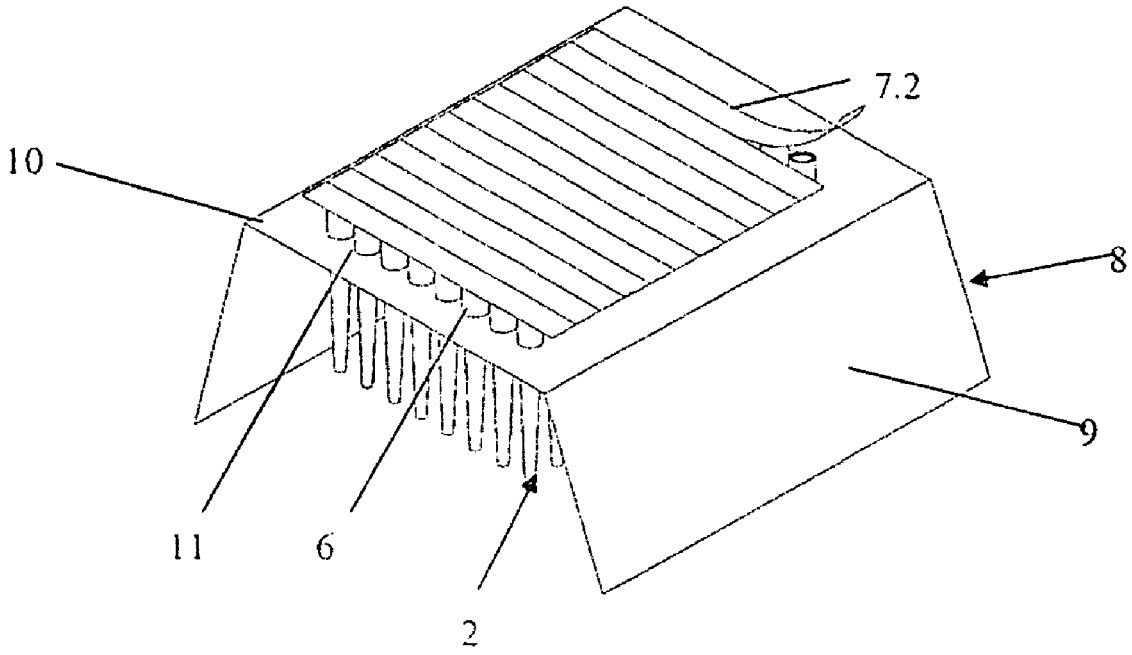

The accompanying drawings constitute a part of the written description of the invention and relate to the detailed description of some embodiments of the invention presented hereinafter. In the drawings, FIG. 1 shows an individual tip package in a cross-sectional view, FIG. 2 shows a multi-tip package and FIG. 3 an individual tip package cut therefrom by stamping, FIG. 4 shows a sliced multi-tip package and FIG. 5 an individual tip package cut therefrom, and FIG. 6 shows the multi-tip package of FIG. 4 in a tray.

DETAILED DESCRIPTION OF SOME EMBODIMENTS OF THE INVENTION

Figure 2:
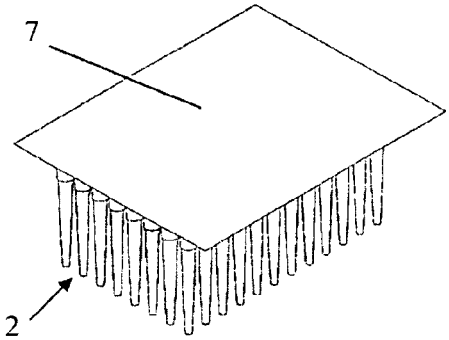

The tip package of FIG. 1 includes a pipette tip 1, placed in a rigid tube 2 which has a closed bottom such that the tip has its bottom end towards the tube's bottom. The tip has its upper part provided with protruding longitudinal ribs 3 whose bottom ends make up a shoulder 4. The tube has a configuration which matches that of the tip but is larger to such an extent that the tip fits inside the tube. The tube has an internal shoulder 5 which responds to that of the tip, thereby preventing the tip's bottom end from touching the tube's bottom. Slightly below the internal shoulder, the tube has its outer surface provided respectively with an external shoulder 6. The tip is placed in the tube from open top end, which is then closed tightly with a lid. The closed package can be sterilized, most preferably by irradiation.

The tip user removes the lid, inserts the end of a pipette's suction channel into the package, whereby the tip has its shoulder 4 pressing against the tube's shoulder 6 and the tip is set firmly in position at the end of the pipette.

Both the tip 1 and the tube 2 are fabricated by injection molding. The tip is placed in the tube, and the thus obtained package is closed immediately, most preferably by heat sealing.

As shown in FIG. 2, several tip packages are closed with a joint lid membrane 7 for a single web of tip packages. This can be cut by stamping for the individual packages of FIG. 3, which are closed by a lid 7.1. This can be done during a manufacturing process, and the individual packages can be packed in bulk containers. However, the web of tip packages can also be delivered as a whole to the user, whereby the user can personally cut the web for smaller units or remove the lid always to an extent enough for picking up the number of tips needed at each time. The web of tips can also be placed in a tip tray, which includes apertures for having the tips suspended thereby.

According to FIG. 2, the tip packages are in the configuration of a rectangular matrix, corresponding for example to the pitch of a 96-well microtitration plate. According to FIG. 4, the lid membrane is perforated between the vertical rows for rectilinear strips 7.2. The user is able to cut a slice for individual packages of FIG. 5, which are provided with a lid 7.1'.

FIG. 6 shows the tip package unit of FIG. 4 loaded in a tray 8. The tray has legs 9 and a lid 10 connecting the same. The lid 10 is provided with apertures 11, in which the tip packages hang suspended from the external shoulder 6 of the tube 2. The strip 7.2 can be removed all at once, thus obtaining by a single action the tips for an 8-channel pipette. If desired, the slice can also be removed little by little for picking up fewer tips at a time.

If desired, the tube 2 below the external shoulder 6 can be further provided with an annular groove for snap-fitting the lid 10 therein, thus providing a robust structure.

The invention claimed is:

1. A pipette tip package, comprising a plurality of individually separable enclosures, each enclosure having a closed bottom end and an open top end, a pipette tip within each of the separable enclosures, the pipette tip having an upper end which can be attached to a pipette and is positioned within the enclosure with the upper end thereof oriented towards the top end of the enclosure, and a flexible joint lid securely attached to the top ends of each of the enclosures to thereby connect the enclosures one to another solely by means of the flexible joint lid and thereby establish a web of pipette tip enclosures, whereby a selected one of the enclosures in the web thereof can be separated from others of the enclosures in the web by partial removal of the flexible joint lid therefrom.

2. The package of claim 1, wherein the joint lid is attached to the top ends of the enclosures by heat sealing.

3. The package of claim 1, wherein the lid is in the form of at least one rectilinear strip for joining multiple ones of the enclosures to one another.

4. The package of claim 1, wherein the joint lid connects the enclosures to form a rectangular matrix comprising at least two linear rows of multiple pipette tip packages.

5. The package of claim 4, wherein the lid is perforated between the rows of enclosures enabling a single row of enclosures to be opened.

6. The package of claim 1, wherein the pipette tips are sterilized.

7. A combination of a pipette tip package and a tray comprising:

(a) a plurality of individually separable enclosures each having a closed bottom end and an open top end;

(b) a pipette tip within each of the separable enclosures, the pipette tip having an upper end which can be attached to a pipette and is positioned within the enclosure with the upper end thereof oriented towards the top end of the enclosure;

(c) a flexible joint lid securely attached to the top ends of each of the enclosures to thereby connect the enclosures one to another solely by means of the flexible joint lid and thereby establish a web of pipette tip enclosures, whereby a selected one of the enclosures in the web thereof can be separated from others of the enclosures in the web by partial removal of the flexible joint lid therefrom; and (d) a tray having an upper surface with multiple apertures for receiving a respective one of the enclosures and a downwardly extending leg for maintaining the upper surface of the tray at a height at least sufficient to accommodate the enclosures.

8. The combination of claim 7, wherein the joint lid is in the form of at least one rectilinear strip for joining multiple ones of the enclosures to one another.

9. The combination of claim 7, wherein the joint lid connects the enclosures to form a rectangular matrix comprising at least two linear rows of multiple pipette tip packages.

10. The combination of claim 9, wherein the joint lid is perforated between the rows of packages enabling a single row of packages to be opened.

11. A method of manufacturing a pipette tip package, comprising:

(a) providing a plurality of individually separable enclosures each having a closed bottom end and an open top end;

(b) placing a number of pipette tips each having an upper end which can be attached to a pipette in respective ones of the enclosures such that the upper end of the pipette tip is oriented towards the top end of the respective enclosure, and thereafter (b) joining a plurality of the separable enclosures one to another solely by means of a flexible joint lid to thereby establish a web of pipette tip enclosures.

12. The method of claim 11, further comprising removing a selected one of the enclosures in the web others of the enclosures in the web by partially removing the flexible joint lid therefrom.

* * * * *